United States Patent [19]

Parry

[11] 4,301,340

[45] Nov. 17, 1981

[54] ELECTRICAL SWITCHGEAR

[75] Inventor: John Parry, Blackwood, United Kingdom

[73] Assignee: South Wales Switchgear Limited, Blackwood, United Kingdom

[21] Appl. No.: 96,069

[22] Filed: Nov. 20, 1979

[30] Foreign Application Priority Data

Nov. 28, 1978 [GB] United Kingdom ..... 46357/78

[51] Int. Cl.[3] ..... H01H 33/18

[52] U.S. Cl. ..... 200/147 R; 200/146 R; 200/148 R

[58] Field of Search ..... 200/147 R, 148 R, 146 R

[56] References Cited

U.S. PATENT DOCUMENTS

| | | | |
|---|---|---|---|
| 1,827,516 | 10/1931 | Greenwood | 200/147 R |
| 2,027,219 | 1/1936 | Austin | 200/147 R |
| 3,274,365 | 9/1966 | Beatty | 200/147 R |
| 3,471,666 | 10/1969 | Barkan | 200/147 R |

*Primary Examiner*—Robert S. Macon

*Attorney, Agent, or Firm*—Charles E. Brown

[57] ABSTRACT

A pair of switches are disposed adjacent one another in a housing which contains the highly insulating gas sulphur hexafluoride. In a closed position of each switch, a pivotable contact arm engages fixed contact fingers to permit the flow of load current therethrough. On opening of each switch, the contact arm pivots away from the fingers so that an arc is drawn therebetween, the arc subsequently being transferred from the fingers to a tubular electrode. The arc current then flows through a field coil connected in series with the electrode, such that a magnetic field is generated which causes the arc to rotate and become extinguished. The electrode and field coil are common to both switches, the contact arms of the latter being disposed respectively at opposite ends of the coil and being isolated from each other by a transverse insulating member disposed centrally in the electrode. The field coil is spirally wound so as to be symmetrical about a transverse plane through its centre, and therefore provides the same operating characteristics for each of the two switches.

7 Claims, 6 Drawing Figures

ELECTRICAL SWITCHGEAR

This invention relates to electrical switchgear, the term "switchgear" being used to embrace circuit breakers and other electrical switches.

Electrical distribution systems make use of non-automatic load-breaking and fault-making switches as well as automatic circuit breakers. Switchgear of the oil-filled type is commonly used for such applications, in which contacts are separated under oil to extinguish an arc formed therebetween. When used with ring main equipment, three switch functions are normally provided in a single oil-filled tank, namely two non-automatic load break switches for controlling respective ring main cables and an automatic fuse switch for controlling a transformer tee-off circuit.

In order to eliminate the possible fire risks which are associated with such oil-filled equipment, switchgear has recently been developed which makes use of the highly insulating gas sulphur hexafluoride to extinguish an arc drawn between contacts. An arc control device is usually required to assist in the interruption of load currents, since it is not generally sufficient to rely on the properties of the gas alone. In one such arc control device, the arc is formed between a movable contact and an electrode which is connected in series with a field coil. The arc current passing through the field coil causes a magnetic field to be generated which makes the arc rotate and become extinguished.

It is an object of the present invention to provide switchgear of the multi-switch type (such as for ring main equipment) which can make use of arc-rotating sulphur hexafluoride techniques in a compact construction.

According to the present invention, there is provided electrical switchgear employing an electrically insulating fluid for arc extinction and comprising a pair of switches each having first and second contact means which are relatively movable between a closed position in which they are mutually engaged and an open position in which they are mutually separated, and an arcing electrode for each switch, movement of each switch to its open position causing an arc to be formed between the first and second contact means thereof, which arc is transferred from the second contact means to the respective arcing electrode so that the arcing current passes through a field coil which is common to both switches to create an arc-rotating magnetic field to extinguish the arc.

Embodiments of the present invention will now be described, by way of example, with reference to the accompanying drawings, in which.

Figure 1:
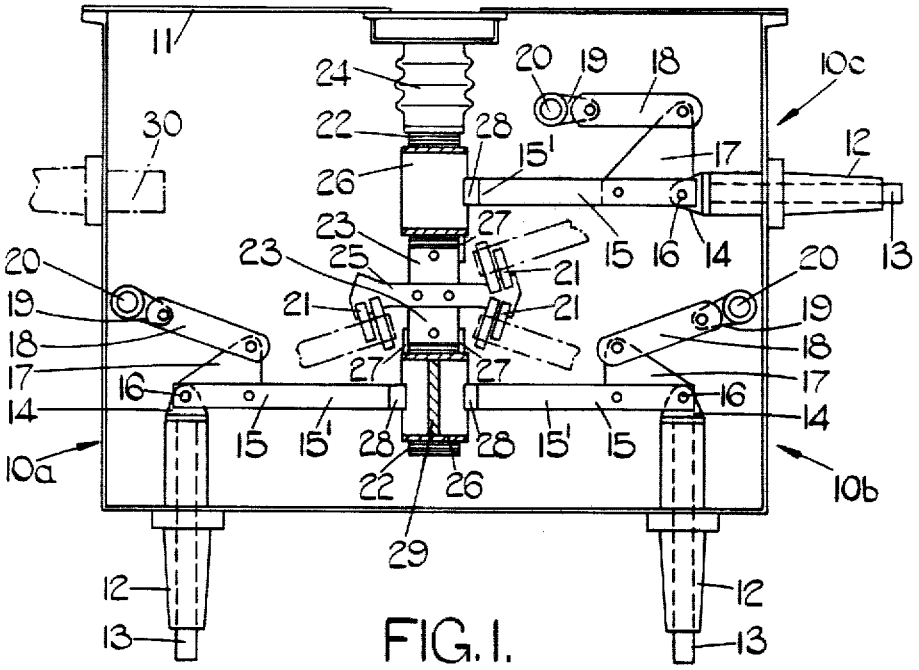
FIG. 1 is a schematic diagram of a first embodiment of electrical switchgear according to the present invention for use with ring main equipment.

The electrical switchgear shown in FIG. 1 comprises generally three switches 10*a*, 10*b* and 10*c* disposed in a gas-tight metal housing 11 which contains sulphur hexafluoride gas, preferably at a pressure of 45 psi or lower.

The switches 10*a* and 10*b* are for controlling respective ring main cables and are disposed adjacent one another. The switch 10*c* is for controlling a transformer tee-off circuit and provides automatic circuit breaking and/or is associated with an externally-mounted high-capacity fuse: where three phases are provided, blowing of one such fuse can be arranged to cause the tee-off switches of all three phases to open.

The three switches 10*a*, 10*b* and 10*c* are generally similar in construction, and therefore only the switch 10*a* will be described in detail. The switch 10*a* includes an insulating bushing 12 which is mounted on the housing 11 and through which a conductor 13 extends. On its end within the housing 11, the conductor 13 carries a mounting 14 on which an electrically conducting contact arm 15 of circular cross-section is mounted for angular movement about a pivot 16. Although not shown, a flexible electrically conductive strap can connect the contact arm 15 to the conductor 13 for the passage of most of the load current therethrough. Alternatively, the load current can be passed through a spring loaded pivotal contact between the conductor 13 and the contact arm 15. The contact arm 15 has a triangular plate 17 secured thereto to which is pivotally connected one end of an insulating linkage 18, the other end of the linkage 18 being pivotally connected to an arm 19 on a rotatable operating shaft 20. Rotation of the shaft 20 by an operating mechanism (not shown) disposed externally of the housing 11 causes the contact arm 15 to move angularly about the pivot 16 between a position (shown in chain-dotted lines) in which an end portion 15' thereof engages a set of fixed, resilient contact fingers 21 and a position (shown in full lines) in which the end portion 15' is disengaged from the fingers 21 and is disposed on the axis of a field coil 22.

In fact, only two field coils are provided, one being common to both of the switches 10*a* andc 10*b*, the contact arms 15 of the latter being disposed respectively on opposite sides of the common field coil. Each field coil is supported by a mild steel support member 23 which surrounds the coil and which shields the latter primarily from the magnetic effects of adjacent metallic parts and current carrying magnetic members, the support members 23 being carried by a common insulating support 24 mounted on the housing 11. The support 24 also carries a conducting support arm 25 on which the contact fingers 21 of all three of the switches 10*a*, 10*b* and 10*c* are commonly mounted.

Each of the field coils 22 comprises a spirally-wound metal strip (for example, twenty turns of sheet metal 0.5 mm thick) whose turns are insulated from one another by means of an insulating coating or an inter-wound insulating strip, the strip being of the same width as the respective support member 23. An outer end of the coil is connected to its support member 23, an inner end thereof being attached to a tubular arcing electrode 26 which is made of non-ferrous metal and which projects beyond the ends of the field coil and its support member. A suitable means of attaching the inner end of the field coil to the arcing electrode is by rivetting and/or by brazing or soldering.

Each of the switches 10*a*, 10*b* and 10*c* operates as follows. In a closed position of the switch, the end portion 15' of the contact arm 15 is engaged with the contact fingers 21 so that a load current can flow therethrough. Opening of the switch is performed by rotating the operating shaft 20 by means of the aforementioned operating mechanism to pivot the contact arm 15 out of engagement with the contact fingers 21. During such movement of the contact arm, the end portion 15' thereof moves transversely relative to the end of the respective field coil 22 to draw an arc from the contact fingers 21 radially across a pole face of the coil. This arc subsequently transfers itself from the contact fingers 21 to the respective arcing electrode 26, so that the field coil (previously out of circuit) now forms part of the current flow path through the circuit breaker. The current flowing through the field coil creates a magnetic field which causes the arc to rotate and become extinguished.

A plate 27 of arc-resistant material is provided adjacent each set of contact fingers 21 to protect the adjacent support members 23 and field coil 22 from the effects of arcing. The arc-resistant material of which the plate 27 is made can be either conducting or insulating. If it is conducting, it must be ensured that the plate cannot short out the adjacent field coil 22. This can be arranged by fixing the plate 27 at an angle to the adjacent support member 23 so that it is normal to the end portion 15' of the respective contact arm 15 when the latter engages the contact fingers 21 and is directed away from the outer windings of the field coil and the support member. If necessary, for certain applications of the switchgear, the end portion 15' of the contact arm 15 can have a region 28 which is also protected by conducting arc-resistant material.

As mentioned above, tyhe switches **10*a*, and 10*b* share a common field coil 22. They may also share a common arcing electrode 26 (as illustrated) but alternatively, separate electrodes could be provided for each switch, the common field coil 22 being electrically connected to each. In order to isolate the contact arms 15 of the switches 10*a* and 10*b* from each other when in their open positions, an electrically insulating member 29 extends transversely across the centre of the common arcing electrode 26**.

Because the common field coil 22 is spirally wound, it is symmetrical about a transverse plane through its centre. The coil 22 can, therefore, be relied on to provide the same operating characteristics for each of the two switches **10*a* and 10*b*. A mechanical interlock (not shown) of known type is provided to prevent simultaneous opening of the switches 10*a* and 10*b***, although consecutive opening (after the arc in one circuit has been extinguished) is permitted.

If desired, a fourth switch can be provided which shares the field coil and arcing electrode of the tee-off switch **10*c* in the same manner as described above in relation to the ring main switches 10*a* and 10b. Again, a mechanical interlock will be used to prevent simultaneous opening of the switches. Reference 30 shows in broken line the manner in which a conductor and bushing for the fourth switch would be arranged on the housing 11**.

Figure 2:
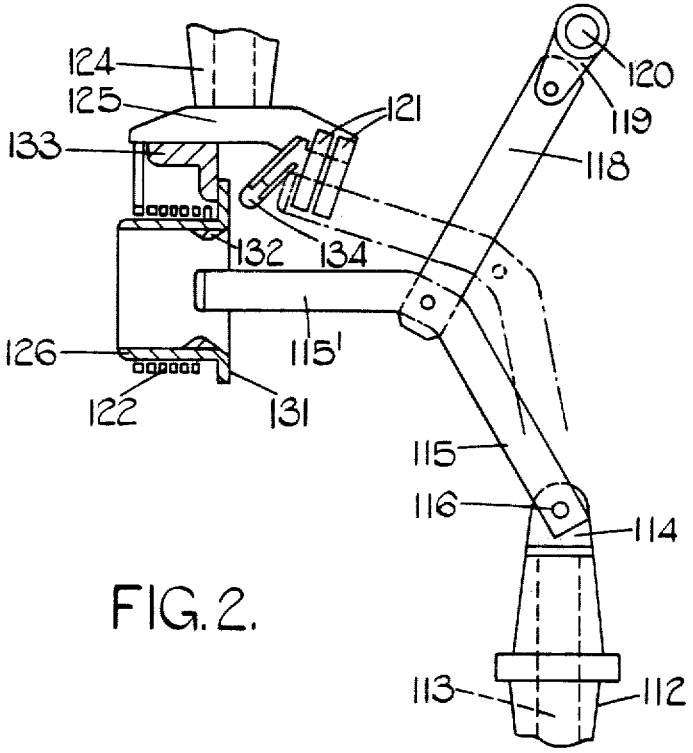
FIG. 2 is shows a number of modifications which can be made to the switchgear illustrated in FIG. 1.

FIG. 2 illustrates a number of modifications which can be applied, singly or in combination, to the electrical switchgear described above. The modifications will be described with particular reference to the tee-off switch **10*c*, but it is to be understood that the modifications can equally well be applied to the ring main switches 10*a* and 10*b*. Those components which correspond to the parts of the switchgear already described are denoted by the same reference numerals as used in FIG. 1 but with 100** added, and will not in general be described again.

In FIG. 2, a cranked contact arm 115 is used instead of a straight one, the arm being pivoted at a point spaced from the axis of the associated field coil 122 so that in the open position of the switch the end portion 115' of the contact arm not only lies along the axis of the field coil but also extends into the adjacent end of the arcing electrode 126. This arrangement helps in transferring the arc from the contact fingers 121 to the electrode 126, and brings the arc within the coil where the magnetic field is more concentrated.

The arcing electrode 126 has a radial flange 131 at an end thereof which faces the contact arm 115 and is also provided with an internal annular insert 132 of bulged cross-section. The insert forms a so-called arc runner along which the arc tracks during its rotation, so that the arc can be made to rotate in a predetermined plane which is chosen with regard to the magnetic field generated by the field coil. The arrangement as illustrated is not suited to being shared between two switches: however, the provision of a flange and an annular insert at the other end of the electrode to give a symmetrical construction and the addition of a central insulating member similar to that referenced 29 in FIG. 1 will enable the arrangement to be made common to two switches.

The field coil 122 is helically, rather than sprially, wound. If the coil is to be shared between two switches, it is to be appreciated that the inherent asymmetry of the helical coil may result in some difference in operating characteristics between the two switches. Because the helical coil 122 is not self-supporting, a separate mechanical support is provided for the arcing electrode 126. This support can be in the form of an electrically-insulating member 133 as shown, or the coil can be cast onto the electrode using, for example, an epoxy resin.

An electrically conductive finger 134 is provided on the support arm 125 adjacent the contact fingers 121, the initial arc being drawn from this finger rather than from the contact fingers 121 when the contact arm 115 moves away from the latter. The finger 134 can thus be made of arc-resistant material, whereas this may not be desirable for the contact fingers 121.

Although not shown, an insulating support cup having a ferromagnetic ring mounted therein can be provided within the arcing electrode 126. The support cup shieldss the ferromagnetic ring from the arc, and the ferromagnetic ring concentrates the magnetic field produced by the field coil 122 to aid arc extinction. The action of the ferromagnetic ring is of particular benefit when breaking relatively low currents.

Additionally, a ferromagnetic yoke (not shown) can be provided adjacent the contact fingers to concentrate the magetic field to encourage the initial arc to stay at the end of the contact arm 115 to facilitate transfer to the electrode 126. If desired, the yoke can be covered in insulating material (for example, epoxy resin) to enable it to be placed close to the initial arc. The yoke enhances the action of the electromagnetic loop defined by the contacts and the arc.

Figure 3:
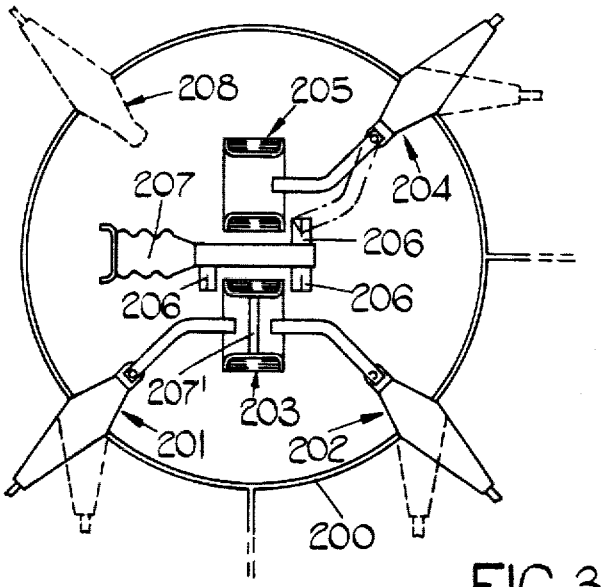
FIG. 3 is a schematic diagram of a second embodiment jof electrical switchgear according to the present invention, also for ring main equipment.

FIG. 3 shows schematically how the features shown in FIGS. 1 and 2 can be combined to produce ring main switchgear of compact form. A metal housing 200 filled with sulphur hexafluoride gas has mounted therein two ring main switches 201 and 202 which share a common field coil assembly 203 and a tee-off circuit-breaking or load break switch 204 which has an associated field coil assembly 205. The field coil assemblies 203 and 205 and fixed contact assemblies 206 for the various switches are all carried by a common insulating support 207. An insulating member 207' is provided transversely of the centre of the shared coil of the coil assembly 203 to isolate the contact arms of the ring main switches 201 and 202 from one another when in their open positions. If desired, a fourther switch whose bushing is indicated in broken line at 208 can also be provided to share the field coil assembly 205 with the switch 204. The conductor bushings for the switches 201, 202 and 204 can be arranged radially of the housing 200 as shown in full lines, or tangentially of the housing as indicated in broken lines.

Figure 4:
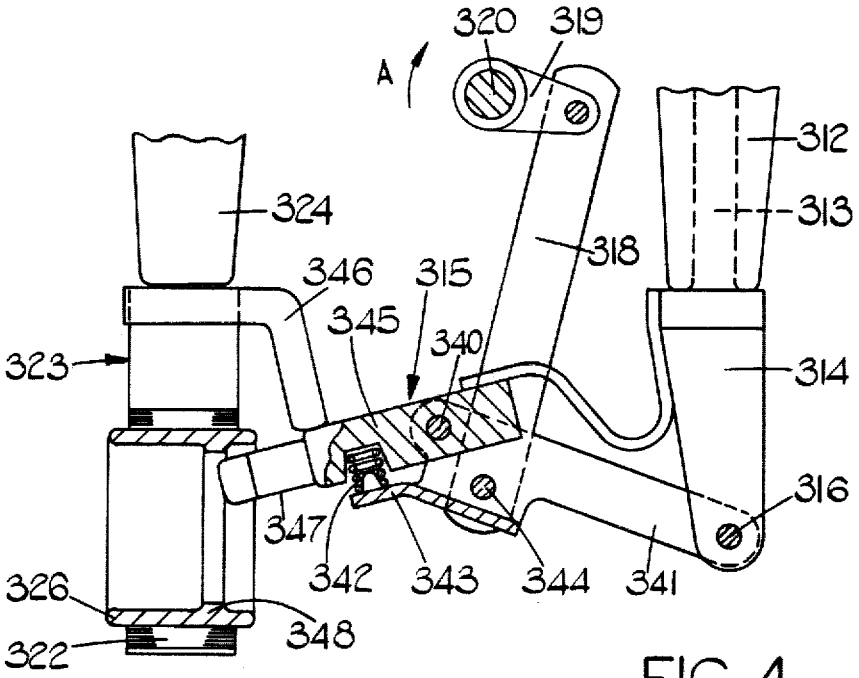
FIGS. 4 to 6 are schematic views of part of a third embodiment of electrical switchgear according to the present invention.
Figure 5:
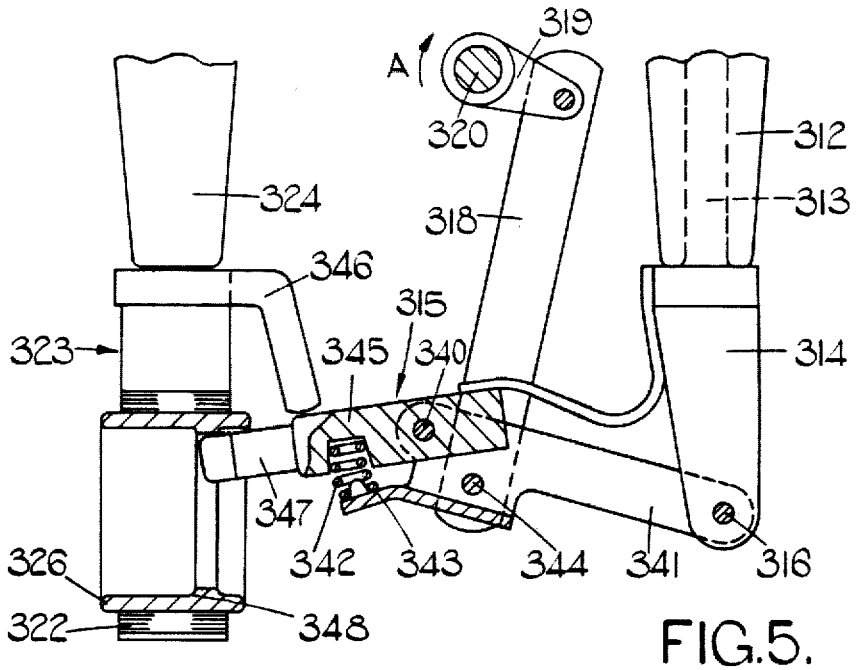
Figure 6:
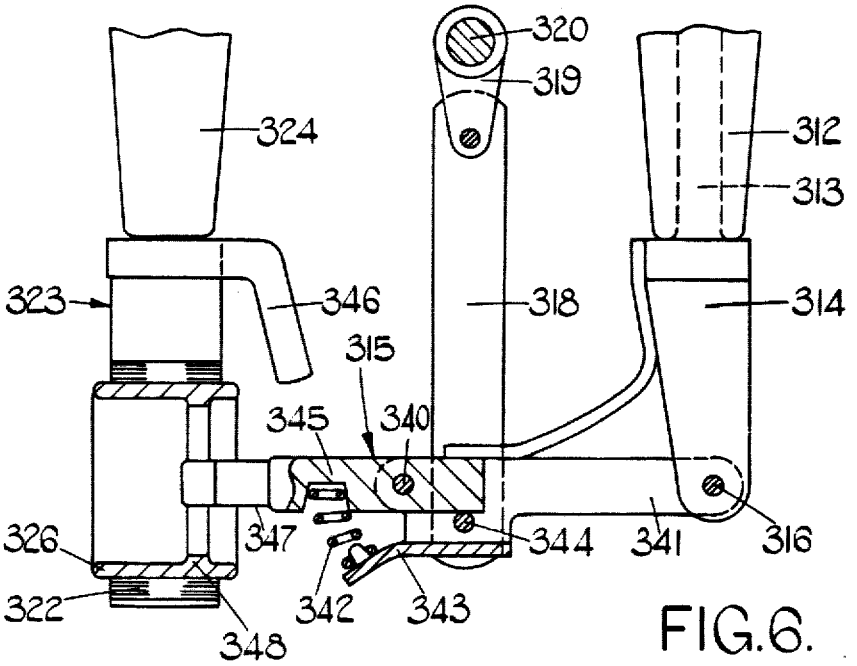

FIGS. 4, 5 and 6 show part of switchgear which is generally similar to that described above with reference to FIG. 1, similar parts being accorded the same reference numerals but with 300 added. The arrangement of the pivotable contact arm of each switch is, however, somewhat modified as will now be described. The modifications will be described with particular reference to the tee-off switch 10*c* of FIG. 1, but it is to be understood that similar modifications can equally well be made to the ring main switches 10*a* and 10*b*.

The contact arm 315 is now pivotally mounted by means of a pivot 340 on one end of a conductive link member 341, a compression spring 342 being interposed between the contact arm and an abutment 343 on the link member. The link member 341 is pivotally mounted at its other end of mounting 314 and is also pivotally connected to linkage 318 by means of a pivot pin 344.

FIG. 4 shows the switch in a closed position in which a main body portion 345 of the contact arm 315 is biased into engagement with a main contact 346 connected to conductor 313. In this position, an end portion 347 of the contact arm is spaced from the arcing electrode 326. The circuit breaker is opened by rotating operating shaft 320 in the direction of arrow A which results in the contact arm 315 rocking on the tip of the main contact 346 until the end portion 347 of the contact arm engages an arc runner 348 on the interior of the electrode 326. Further rotation of the operating shaft 320 causes the contact arm 315 to disengage from the main contact 346 while still remaining in contact with the arc runner 348, as shown in FIG. 5.

On continued rotation of the shaft 320, the end portion 347 of the contact arm 315 maintains contact with the arc runner 348 until the main body portion 345 comes into egagement with the pivot pin 344 which acts as a stop. Thereafter, the end portion 347 moves away from the arc runner 348 transversely of the field coil axis so that an arc is drawn therebetween radially within the field coil 322. In the fully-open position of the switch, shown in FIG. 6, the end portion 347 of the contact arm lies along the field coil axis and the arc rotates to extinction under the effect of the magnetic field produced by the field coil.

As an alternative to the use of circular cross-section components, the contact arm can be of rectangular cross-section, and the field coils and arcing electrodes can be of oval cross-section.

The invention has other applications besides the distribution switchgear described above. It is applicable to the control of industrial circuits, and to distribution and transmission circuits at higher voltages. It can also be applied to circuit breakers and switches having an insulated enclosure.

I claim:

1. Electrical switchgear comprising:

(a) a housing containing an electrically insulating fluid;

(b) a pair of switches disposed in said housing, each said switch including first contact means and second contact means which are relatively movable between a closed position in which said first and second contact means are mutually engaged and an open position in which said first and second contact means are mutually separated, movement of said first and second contact means out of said closed position and towards said open position causing an electrical arc discharge to be drawn therebetween;

(c) electrically conductive arcing electrode means disposed in said housing and to which said electrical arc discharge is transferred from said second contact means upon further movement of said first and second contact means of each said switch towards said open position; and (d) a field coil which is common to both said switches and which is electrically connected to said arcing electrode means, an arcing current flowing through said field coil when said electrical arc discharge is transferred to said arcing electrode means from either of said switches and producing a magnetic field which causes said electrical arc discharge to rotate between said first contact means and said arcing electrode means and to become extinguished.

2. The electrical switchgear according to claim 1, wherein said arcing electrode means is in the form of an electrically conductive member which is common to both of said switches.

3. The electrical switchgear according to claim 1, wherein said arcing electrode is tubular, and an electrically insulating member is arranged transversely within said tubular arcing electrode means to assist in isolating said first contact means of said switches from each other.

4. The electrical switchgear according to claim 1, wherein said arcing electrode means is tubular, and said field coil is wound on an external surface thereof.

5. The electrical switchgear according to claim 1, wherein said field coil is formed by a spirally wound electrically conductive strip.

6. The electrical switchgear according to claim 1, wherein said field coil is composed of a strip of electrically conductive material wound in a spiral, said spiral having an outer end which is attached to mounting means and an inner end which mounts said arcing electrode means.

7. The electrical switchgear according to claim 1, wherein the electrically insulating fluid is sulphur hexafluoride gas.

* * * * *